US005959619A

United States Patent [19]

Kameyama et al.

[11] Patent Number: 5,959,619

[45] **Date of Patent: *Sep. 28, 1999**

[54] DISPLAY FOR PERFORMING GRAY-SCALE DISPLAY ACCORDING TO SUBFIELD METHOD, DISPLAY UNIT AND DISPLAY SIGNAL GENERATOR

[75] Inventors: Shigeki Kameyama; Tomokatsu Kishi, both of Kawasaki, Japan

[73] Assignee: Fujitsu, Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/612,103

[22] Filed: Mar. 7, 1996

[30] Foreign Application Priority Data

Sep. 19, 1995 [JP] Japan ..... 7-239661

[51] Int. Cl.[6] ..... G09G 5/00

[52] U.S. Cl. ..... 345/204

[58] Field of Search ..... 345/67, 147–148, 345/204; 348/797

[56] References Cited

U.S. PATENT DOCUMENTS

| | | | |
|---|---|---|---|
| 3,845,243 | 10/1974 | Schmersal et al. | 348/797 |
| 3,937,878 | 2/1996 | Judice | 345/147 |
| 4,639,879 | 1/1987 | Chaya | 345/147 |
| 5,091,722 | 2/1992 | Kitajima et al. | 345/147 |
| 5,420,602 | 5/1995 | Kanazawa | 345/67 |
| 5,436,634 | 7/1995 | Kanazawa | 345/67 |
| 5,706,035 | 1/1998 | Tsunoda et al. | 345/213 |

FOREIGN PATENT DOCUMENTS 0261901 3/1988 European Pat. Off. .

6282243 10/1994 Japan .

OTHER PUBLICATIONS

The Digest of Technical Papers, IEEE International Conference on Consumer Electronics; Jun. 7–9 1995; pp. 198, 199; B. Mercier et al: "A New Video Storage Architecture for Plasma Panel Displays"; p. 198, left col., lines 14–22; p. 198, right col., line 9; p. 199, left col., line 15; figures 1–3.

IEEE Transactions on Consumer Electronics, vol. 42, No. 1, Février 1996, New York; pp. 121–127; B. Mercier et al: "A New Video Storage Architecture for Plasma Display Panels" p. 126, right col., lines 3–15.

*Primary Examiner*—Amare Mengistu
*Assistant Examiner*—Ronald Laneau
*Attorney, Agent, or Firm*—Greer, Burns & Crain Ltd.

[57] ABSTRACT

A display for performing gray-scale display according to a subfield method, in which the frame memory area is minimized, has been disclosed. The display comprises: a main unit including a video signal source and a display interface having a frame memory; a display panel unit including a matrix panel for performing gray-scale display according to the subfield method, a driver for driving the matrix panel, and a display control unit for receiving display signals from the display interface in the main unit and controlling the driver according to the display signals; and a cable for linking the main unit and display panel unit. The display interface transmits display signals covering one frame in units of a subfield. This obviates the necessity of a frame memory that is employed in a known display adopting a CRT interface as an interface between the main unit and display panel unit and that is used to convert display signals adapted to the CRT interface into those adapted to the subfield method.

12 Claims, 18 Drawing Sheets

DISPLAY FOR PERFORMING GRAY-SCALE DISPLAY ACCORDING TO SUBFIELD METHOD, DISPLAY UNIT AND DISPLAY SIGNAL GENERATOR

BACKGROUND OF THE INVENTION

1. Field of the Invention

The present invention relates to a display panel unit, comprising a set of cells, which is a display device having a memory function, and to a data transmission system for transmitting display signals from a main unit to the display panel unit. More particularly, this invention is concerned with a display for performing gray-scale display according to a subfield method, a display panel unit constituting the display, and a display signal generator that is incorporated in the main unit for supplying display signals to the display panel unit.

2. Description of the Related Art

An alternating current (hereinafter AC) plasma display panel (PDP) is typical of a display device having a memory function. The present invention can apply to displays for performing gray-scale display according to a subfield method and is not limited to displays using an AC plasma display panel. Herein, however, description will proceed by taking a display using an AC plasma display panel for instance.

The AC PDP is designed to sustain discharge by applying a voltage alternately to two sustaining electrodes and to thus glow for display. One discharge is completed in one to several microseconds after application of a pulse. Ions that are a positive charge generated by discharge are accumulated on the surface of an insulating layer over one electrode to which a negative voltage is applied. Likewise, electrons that are a negative charge are accumulated on the surface of an insulating layer over another electrode to which a positive voltage is applied.

After a pulse (writing pulse) of a high voltage (writing voltage) is used to induce discharge and produce a wall charge, and when a pulse (sustaining pulse or sustaining discharge pulse) of a lower voltage (sustaining voltage or sustaining discharge voltage) whose polarity is opposite to that of the previous voltage is applied, the previously-accumulated wall charge is duplicated. Consequently, a voltage to be induced in a discharge space increases and eventually exceeds a threshold of a discharge voltage. Discharge then starts. In short, a cell has a feature that once a wall charge is produced by performing one writing discharge, when a sustaining pulse is applied by alternating the polarity, discharging is sustained. This feature is referred to as a memory effect or memory function. In general, the AC type PDP achieves display by utilizing the memory effect.

A PDP cannot vary the intensity of glowing. Luminance is substantially varied by changing the period of glowing, whereby gray-scale display is achieved. Gray-scale display in the PDP is usually achieved by associating each bit of display data with a period of a subfield and varying the length of a subfield according to the degree of weighting each bit. Taking 256-level gray-scale display for instance, display data is composed of eight bits. One frame is displayed for the period of eight subfields. Each bit data is displayed for an associated subfield. The ratio of lengths of subfields is 1:2:4:8:16:32:64:128. One subfield is divided into a reset period, addressing period, and sustaining discharge period. During the reset period, a whole-screen writing pulse is applied to execute self-erasure discharge. All cells in a panel assume a uniform state devoid of a wall charge. During the addressing period, addressing discharge is executed line-sequentially so that a quantity of wall charge permitting sustaining discharge is stored in cells to be allowed to glow. Thus, cells are tuned on or off according to display data. Thereafter, sustaining discharge is executed and an image for one subfield is displayed. In this "addressing/sustaining discharge-separated writing addressing system," luminance is determined with the length of a sustaining discharge period; that is, the number of sustaining pulses. For brighter display, the sustaining discharge period within a frame must be made longer.

For gray-scale display, one frame must be composed of several subfields associated with different glowing frequencies. The same number of addressing cycles as the number of display lines is needed for each subfield.

As described above, a display device that cannot vary the glowing intensity achieves gray-scale display according to a subfield method. It is therefore required to supply display data to a driver in a panel in a format matched with the subfield method.

In an existing large-screen multicolor display type flat-panel display, a digital RGB interface conformable to the specifications of input timing for a CRT is generally adopted. This is because the main unit of the existing display usually outputs signals adapted to a CRT interface and the signals are intended to be shared with the main unit. A display interface is therefore provided with a CRT controller (CRTC) and video RAM. Display data is developed in the video RAM, and then read and output in conformity with the specifications of input timing for a CRT.

As mentioned above, in the known display, the main unit transmits display data to a display panel unit in a format adapted to the CRT interface. In this case, a frame memory must be installed in the main unit and display panel unit respectively. The frame memory must have a capacity that is large enough to store bits representing gray-scale levels for each display pixel. When the number of pixels is large, an enormous memory area becomes necessary. In particular, for color display, three frame memories must be installed. The necessary memory area gets larger. In addition, when it is attempted to unintermittently display data of frames that are input consecutively, the display panel unit is requested to write data of the next frame while reading out written data from a frame memory. The same number of frame memories as the number of a plurality of frames must therefore be prepared so that the frame memories can be switched in order to perform writing and reading concurrently. Consequently, the necessary memory area further expands.

As mentioned above, the display for performing gray-scale display according to the subfield method has a problem in that the frame memory area is large. This poses a problem of increase in cost.

SUMMARY OF THE INVENTION

An object of the present invention is to minimize the frame memory area in a display for performing gray-scale display according to a subfield method.

A display of the present invention comprises: a main unit including a video signal source and a display interface having a frame memory; a display panel unit including a matrix panel for performing gray-scale display according to the subfield method, drivers for driving the matrix panel, and a display control unit for receiving display signals from the display interface in the main unit and controlling the drivers so that display can be achieved according to the display signals; and a cable for linking the main unit and display panel unit. The display interface is characteristic of transmitting display signals covering one frame in units of a subfield.

The present invention notes that the known display has frame memories having similar abilities installed in the main unit and display panel unit respectively, and thus attempts to minimize a frame memory area by adopting one of the frame memories as a common memory and eliminating the other memory. In the known display, a CRT interface is used as an interface between the main unit and display panel unit. A frame memory for converting display signals adapted to the CRT interface into those adapted to the subfield method must therefore be installed in the display panel unit. In the present invention, the display signals to be transmitted from the main unit to the display panel unit are produced in a format matched with the subfield method. Transmitted display signals can therefore be used by the display unit as they are. This obviates the necessity of writing and reading data, which is needed for converting one data format into another in the display panel unit, into and from a frame memory. It becomes possible to minimize the memory area and to downsize the logic circuits. Moreover, since the time required for conversion becomes unnecessary, the response characteristic improves.

In the subfield method, time-sharing control is performed for each subfield associated with one bit of a display signal. For transmitting display signals from a main unit to a display panel unit, one bit of the display signal associated with each subfield is sent according to the timing of the subfield. When the order of the subfields or the length of a subfield is predetermined, a display interface sends display data signals according to the predetermined timing, and a display control unit in the display panel unit receives the signals according to the timing.

Alternatively, the display interface may output a subfield synchronizing (hereinafter sync) signal indicating the timing of starting transmission for each subfield in addition to sync signals Vsync and Hsync. In this case, the display control unit identifies the subfield sync signal and performs the processing for attaining synchronism.

When the display panel unit varies the order of subfields during which lighting is effected; that is, the lighting order of subfields, the display control unit transmits the information of the lighting order of subfields to the main unit. The display interface transmits display signals according to the transmitted lighting order information.

In the subfield method, the lighting order of subfields is varied in order to prevent the deterioration in display quality resulting from flickers, false contours, or the like of images. For varying the lighting order of subfields, the display panel unit transmits the lighting order of subfields to the main unit. Display signals are then transmitted according to the transmitted lighting order information, whereby display is achieved normally.

When the display panel unit writes display data concurrently in a plurality of blocks into which the matrix panel is segmented, the display interface transmits display signals in parallel in association with the plurality of blocks.

In a display for writing data concurrently in display cells; such as, a display panel unit, the writing speed is determined by the ability of a driver for driving address lines (data lines) to drive a data shift register. For increasing the writing speed or operating speed, the driving ability relative to the data shift register must be improved. However, there is a limit in the improvement. Therefore, the address lines are grouped into a plurality of blocks, and data is written concurrently in the blocks. In this case, a display interface 3 should transmit display signals in parallel in association with the plurality of blocks.

BRIEF DESCRIPTION OF THE DRAWINGS

The present invention will be more clearly understood from the description as set forth below with reference to the accompanying drawings, wherein.

Figure 1:
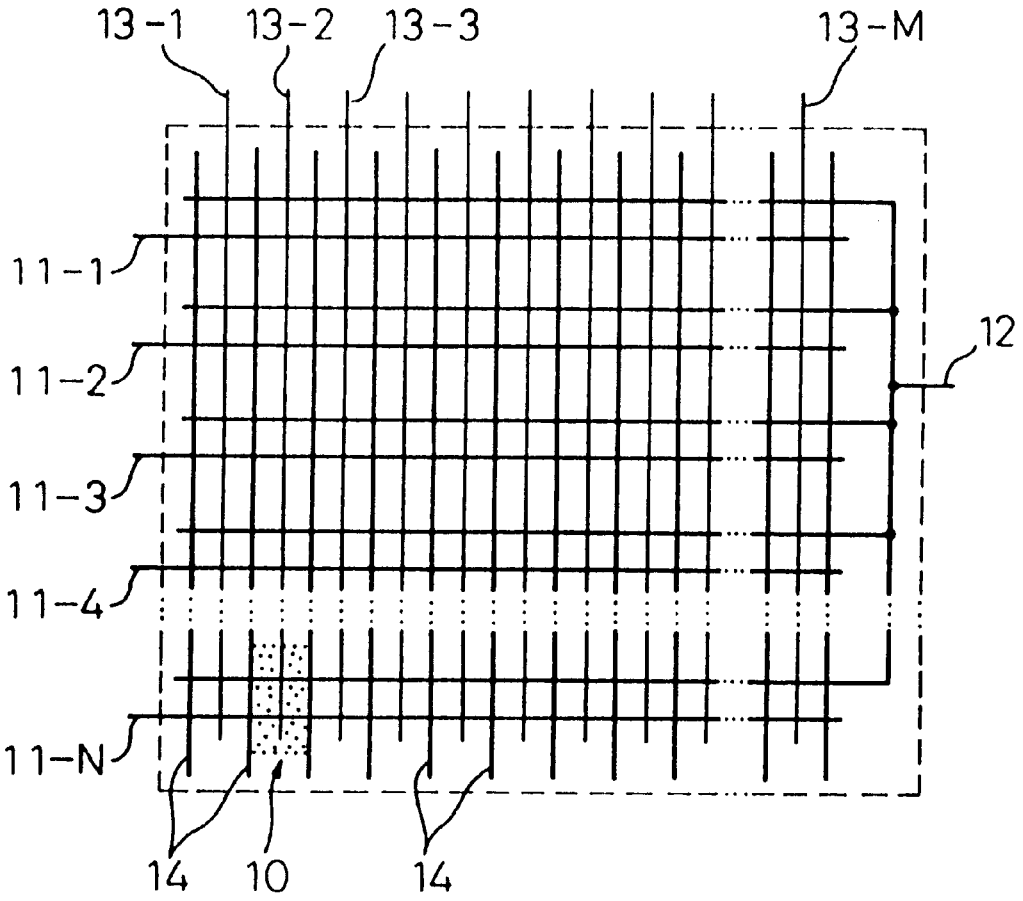
Fig. 1 PRIOR ART
FIG. 1 is a schematic plan view of a three-electrode surface-discharge type AC PDP.

Before proceeding to a detailed description of the preferred embodiments of the present invention, prior art plasma displays and prior art interface will be described, with reference to the accompanying drawings thereto, for a clearer understanding of the differences between the prior art and the present invention.

AC PDPS are available as a dual-electrode type in which two kinds of electrodes are used to perform selective discharge (addressing discharge) and sustaining discharge and a triple-electrode type in which third electrodes are used to perform addressing discharge. In a color PDP for performing gray-scale display, fluorescent substances formed in discharge cells are excited by infrared rays stemming from discharge. The fluorescent substance has a drawback in that it is susceptible to the impact of ions that are positive charges stemming from discharge. As for the dual-electrode type having a structure that allows the fluorescent substances to be hit directly by ions, there is a possibility that the service lives of the fluorescent substances are shortened. To avoid this shortening, the color PDP generally adopts the triple-electrode structure based on surface discharge. Moreover, the triple-electrode type is classified into a type in which the third electrodes are formed on a substrate on which the first and second electrodes for performing sustaining discharge are arranged, and a type in which the third electrodes are formed on another substrate opposed to the substrate on which the first and second electrodes are arranged. In addition, the type in which three kinds of electrodes are formed on the same substrate is classified into a type in which the third electrodes are placed on the other two kinds of electrodes for performing sustaining discharge, and a type in which the third electrodes are placed under the two kinds of electrodes. Furthermore, there is a type in which visible light emanating from fluorescent substances is seen through the fluorescent substances (transparent type) and a type in which light reflected from the fluorescent substances is seen (reflection type). The spatial coupling of a cell to be allowed to discharge with an adjoining cell is cut off by a barrier (or rib). The barrier may be placed on four sides in order to enclose a discharge cell so that the discharge cell can be sealed perfectly. Alternatively, the barrier may be placed in one way alone and the coupling between electrodes in the opposite way may be cut off by optimizing the gap (distance) between the electrodes. The present invention can apply to any of the structures. Herein, description will proceed by taking the reflection type for instance. Specifically, a panel has the third electrodes formed on a substrate opposed to another substrate on which electrodes for performing sustaining discharge are formed, barriers are formed only in a vertical direction (that is, orthogonal to the first and second electrodes and parallel to the third electrodes), and some of sustaining electrodes are realized with transparent electrodes.

Figure 2:
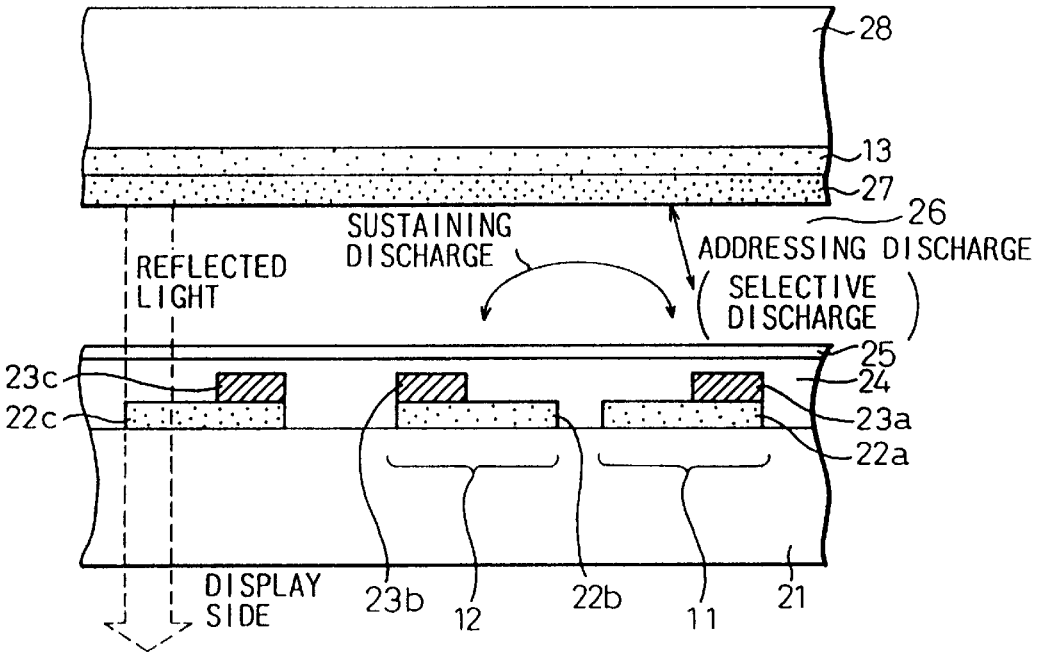
Fig. 2 PRIOR ART
FIG. 2 is a schematic sectional view of the three-electrode surface-discharge type AC PDP.
Figure 3:
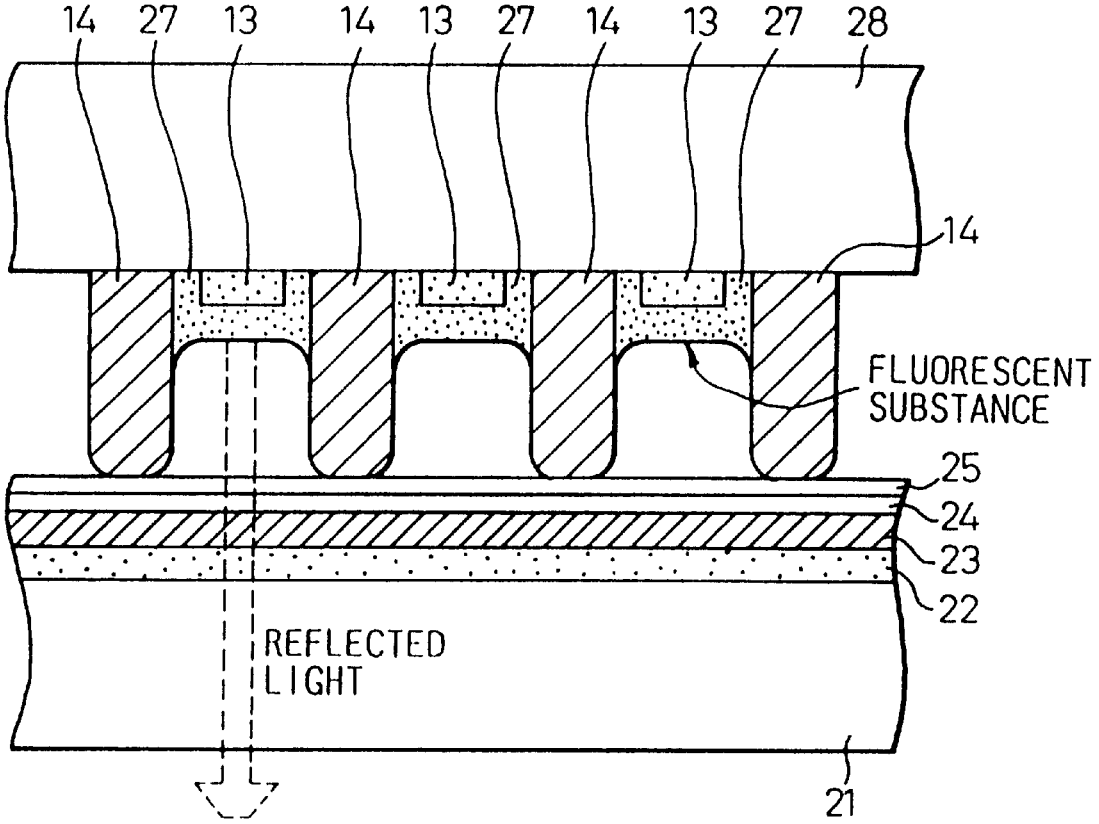
Fig. 3 PRIOR ART
FIG. 3 is a schematic sectional view of the three-electrode surface-discharge type AC PDP.

What is shown in the schematic plan view of FIG. 1 is known as the triple-electrode surface-discharge type PDP. FIG. 2 is a schematic sectional view (vertical direction) of one discharge cell 10 in the panel shown in FIG. 1. FIG. 3 is a schematic sectional view showing one discharge cell in a horizontal direction. In the drawings to be referred to below, the same functional parts will be assigned the same reference numerals.

A panel comprises two glass substrates 21 and 28. The first substrate 21 includes first electrodes (X electrodes) 12 and second electrodes (Y electrodes) 11 which serve as sustaining electrodes and are parallel to one another. These electrodes are realized with transparent electrodes 22*a* and 22*b* and bus electrodes 23*a* and 23*b*. The transparent electrodes are designed to fill the role of transmitting reflected light stemming from fluorescent substances and are therefore formed with an ITO (transparent conductive membrane whose main component is indium oxide) or the like. The bus electrodes must be formed to have a low resistance in order to prevent a voltage drop resulting from an electric resistance, and are therefore made of chromium (Cr) or copper (Cu). These electrodes are coated with an inductive layer (glass) 24. A membrane 25 made of magnesium oxide (MgO) is formed as a protective membrane on a discharge side. In a second substrate 28 opposed to the first glass substrate 21, third electrodes (address electrodes) 13 are formed orthogonally to the sustaining electrodes. Barriers 14 are formed among the address electrodes. A fluorescent substance 27 having a characteristic of glowing in red, green, or blue is formed between each pair of barriers so that the fluorescent substance can cover an address electrode. The two glass substrates are assembled so that the ridges of the barriers 14 can be in close contact with the MgO membrane 25. Spaces between the fluorescent substances 27 and the MgO membrane 25 serve as discharge spaces 26.

Figure 4:
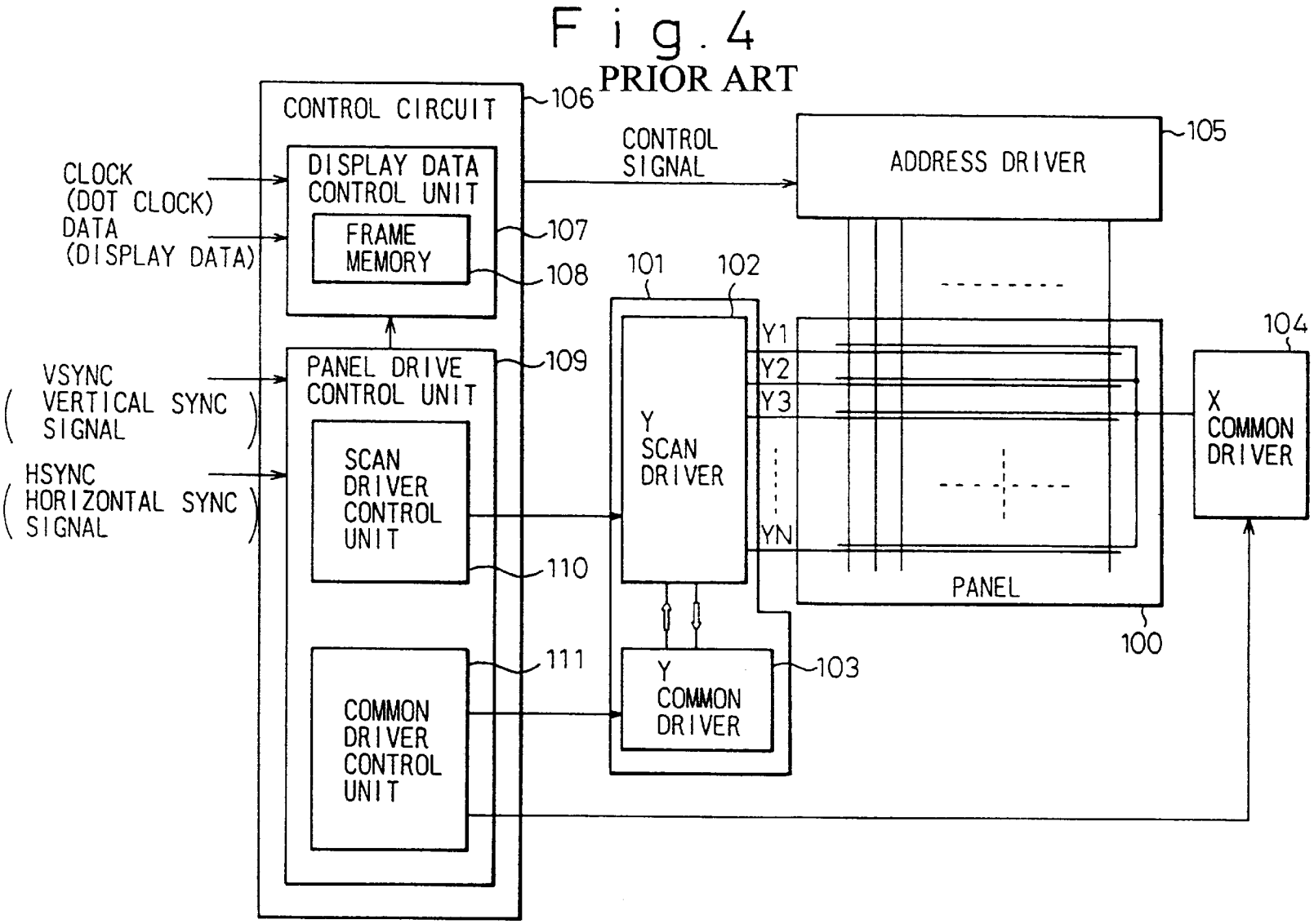
Fig. 4 PRIOR ART
FIG. 4 is a block diagram of the three-electrode surface-discharge type AC PDP.

FIG. 4 is a schematic block diagram showing peripheral circuits for driving the PDP shown in FIGS. 1 to 3. The address electrodes 13-1, 13-2, etc. are independently connected to an address driver 105. The address driver applies an addressing pulse for addressing discharge. The Y electrodes 11-1, 11-2, etc. are connected to a Y driver 101. The Y driver 101 comprises a Y scan driver 102 and a Y common driver 103. The Y electrodes are independently connected to the Y scan driver 102. The Y scan driver 102 is connected to the Y common driver 103. During addressing discharge, a pulse is generated by the Y scan driver 102. A sustaining pulse or the like is generated by the Y common driver 103, and applied to a Y electrode via the Y scan driver 102. The X electrodes 12 are connected in common along all display lines for signal fetching. An X common driver 104 generates a writing pulse, sustaining pulse, and the like. These driver circuits are controlled by a control circuit. The control circuit is controlled by synchronizing (hereinafter sync) signals and display data signals fed externally to the display.

In a PDP, the intensity of glowing cannot be varied. Gray-scale display is therefore achieved by varying the period of glowing to substantially vary luminance. Gray-scale display in the PDP is such that, generally, each bit of display data is associated with a period of a subfield, and the length of a subfield is varied according to the degree of weighting an associated bit. Taking 256-level gray-scale display for instance, display data is composed of eight bits. One frame is displayed during the period of eight sub-fields, and each bit data is displayed during an associated subfield. The ratio of the lengths of sub-fields is 1:2:4:8:16:32:64:128.

Figure 5:
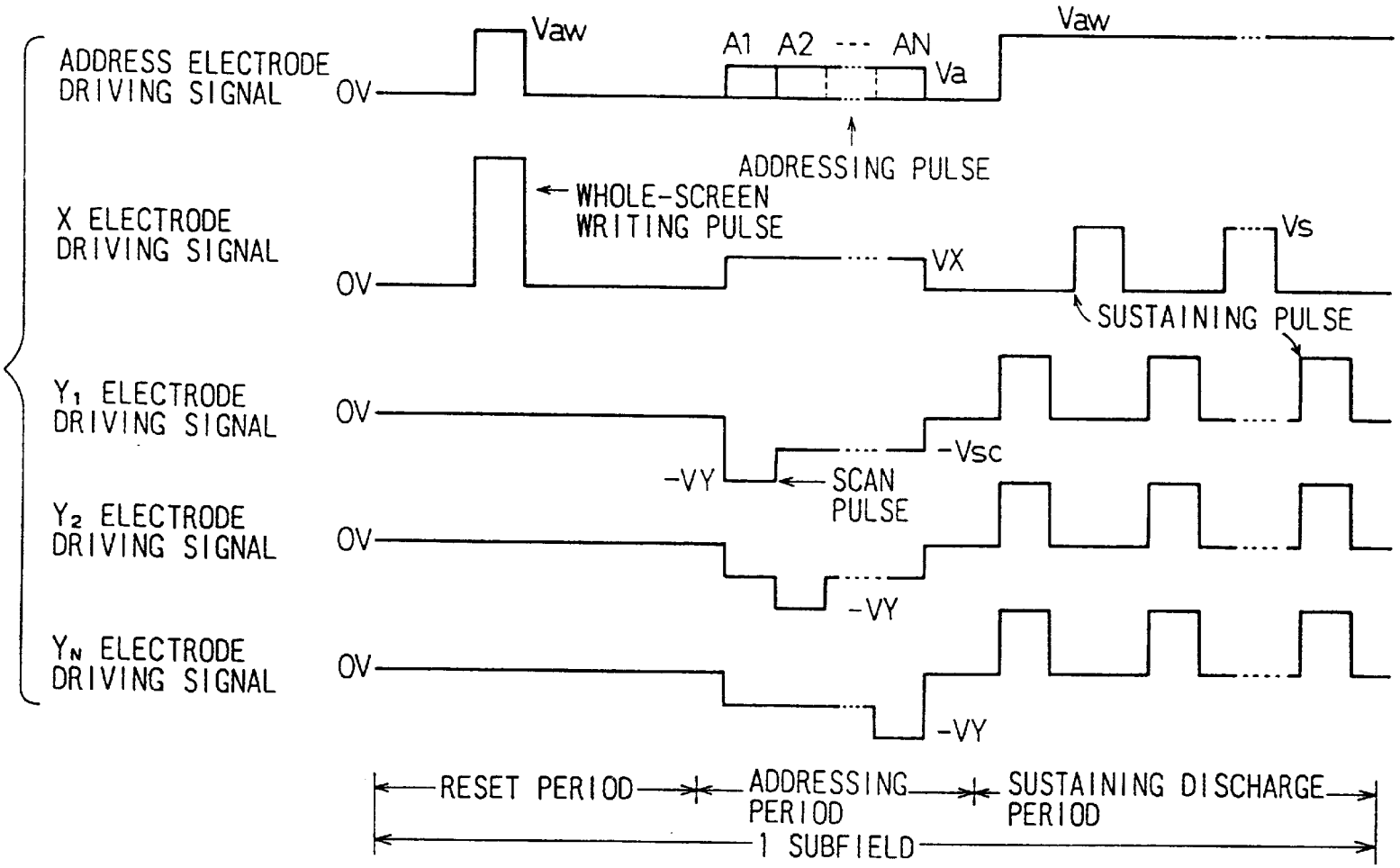
Fig. 5 PRIOR ART
FIG. 5 is a chart showing known waveforms of driving signals.

FIG. 5 is a waveform chart illustrating a known method for driving the PDP shown in FIGS. 1 to 3 using the circuitry shown in FIG. 4. FIG. 5 is concerned with one subfield in the so-called known "addressing/sustaining discharge-separated writing addressing system." In this example, one subfield is divided into a reset period, addressing period, and sustaining discharge period. During the reset period, all the Y electrodes are reset to the level of 0 V. At the same time, a whole-screen writing pulse whose voltage is Vs+Vw (approximately 330 V) is applied to the X electrodes. All the cells on all display lines then discharge irrespective of the ongoing display state. The potentials at the address electrodes at this time are approximately 100 V (Vaw). The potentials at the X electrodes and address electrodes are 0 V. At all the cells, the voltage induced by a wall charge itself exceeds a discharge start voltage. Discharge is then started. This discharge neutralizes by itself and ceases. This is what is called "self-erasure discharge." The self-erasure discharge brings all the cells in the panel into a uniform state devoid of a wall charge. The reset period exerts the effect of bringing all the cells into the same state irrespective of the lighting state during the previous subfield. Thus, the reset period is provided for executing the next addressing (writing) discharge on a stable basis.

During an addressing period, addressing discharge is executed line-sequentially in order to turn on or off the cells according to display data. First, a scan pulse of a–VY level (approximately −150 V) is applied to the Y electrodes. An addressing pulse of a voltage Va (approximately 50 V) is applied selectively to the address electrodes coincident with cells to be lit. Discharge occurs between the address electrodes and Y electrodes of the cells to be lit. The discharge acts as priming so as to bring about discharge between the X electrodes (voltage Vx=50 V) and Y electrodes. Consequently, a quantity of wall charge enabling sustaining discharge is accumulated on the MgO membrane covering both the electrodes.

The aforesaid operation is performed sequentially for the other display lines. Eventually, new display data is written for all the display lines.

Thereafter, when it comes to a sustaining discharge period, a sustaining pulse of a voltage Vs (approximately 180 V) is applied alternately to the Y electrodes and X electrodes. This results in sustaining discharge. An image for one subfield is displayed. At this time, a voltage Vaw of approximately 100 V is applied to the address electrodes in order to prevent discharge from occurring between the address electrodes and the X electrodes or Y electrodes.

In the "addressing/sustaining discharge-separated writing addressing system," luminance is determined with the length of a sustaining discharge period; that is, the number of sustaining pulses.

Figure 6:
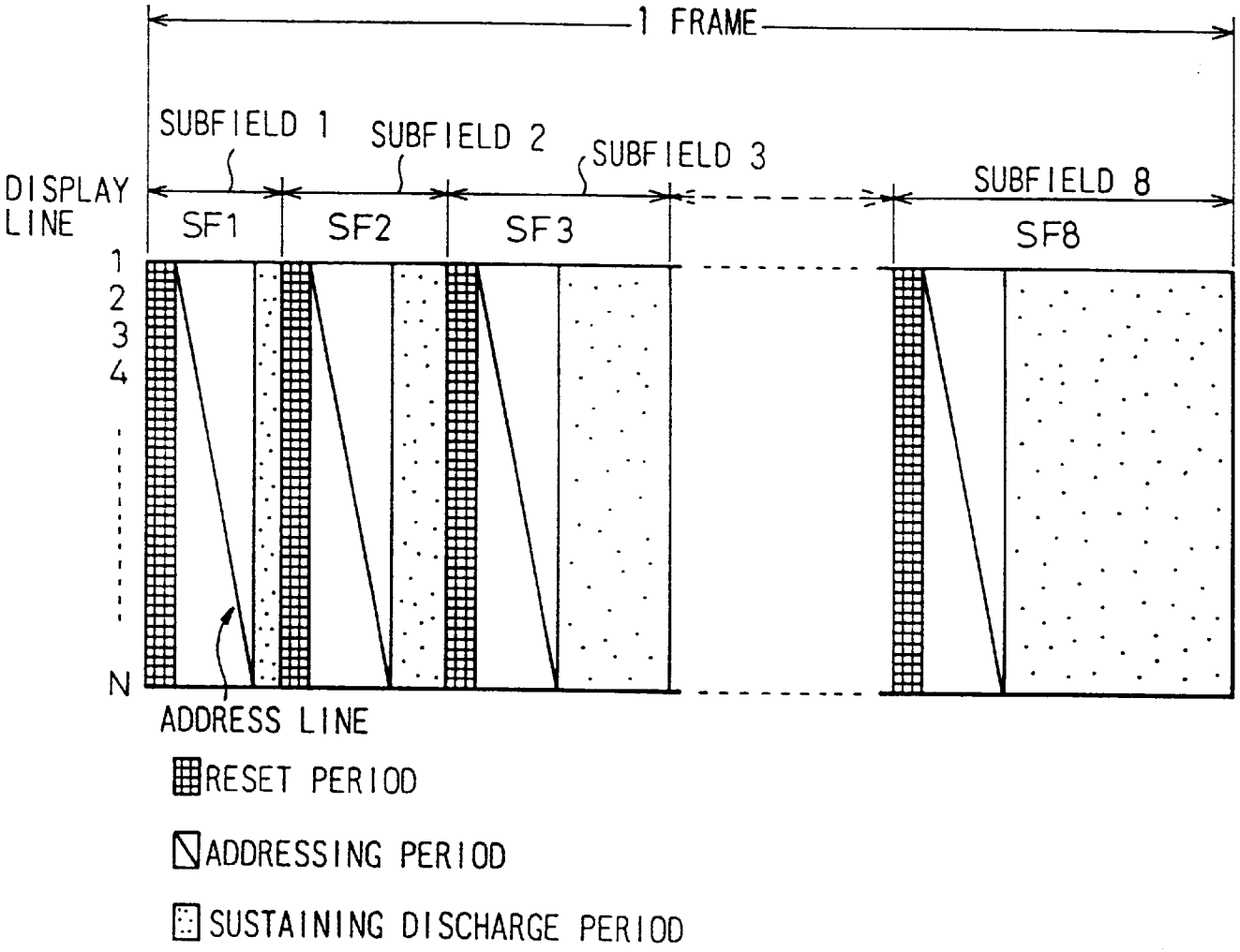
Fig. 6 PRIOR ART
FIG. 6 is a timing chart concerning an addressing/sustaining discharge-separated addressing system for performing gray-scale display in a PDP.

A driving method applicable to a 256-level gray-scale display is shown as an example applicable to multilevel gray-scale display in FIG. 6. In this example, one frame is segmented into eight subfields SF1 to SF8.

Within these subfields SF1 to SF8, reset periods and addressing periods have the same lengths. The ratio of the lengths of sustaining discharge periods is 1:2:4:8:16:32:64:128. By selecting subfields during which lighting is effected, a difference in luminance can be displayed in 256 gray-scale levels ranging from level 0 to 255.

For gray-scale display, one frame must be composed of several subfields associated with different glowing frequencies. The same number of addressing cycles as the number of display lines is therefore needed for each subfield.

As described above, in a display device that cannot vary the glowing intensity, gray-scale display is achieved according to a subfield method. Display data must therefore be supplied to a driver in a panel in a format matched with the subfield method as shown in FIG. 6.

Figure 7:
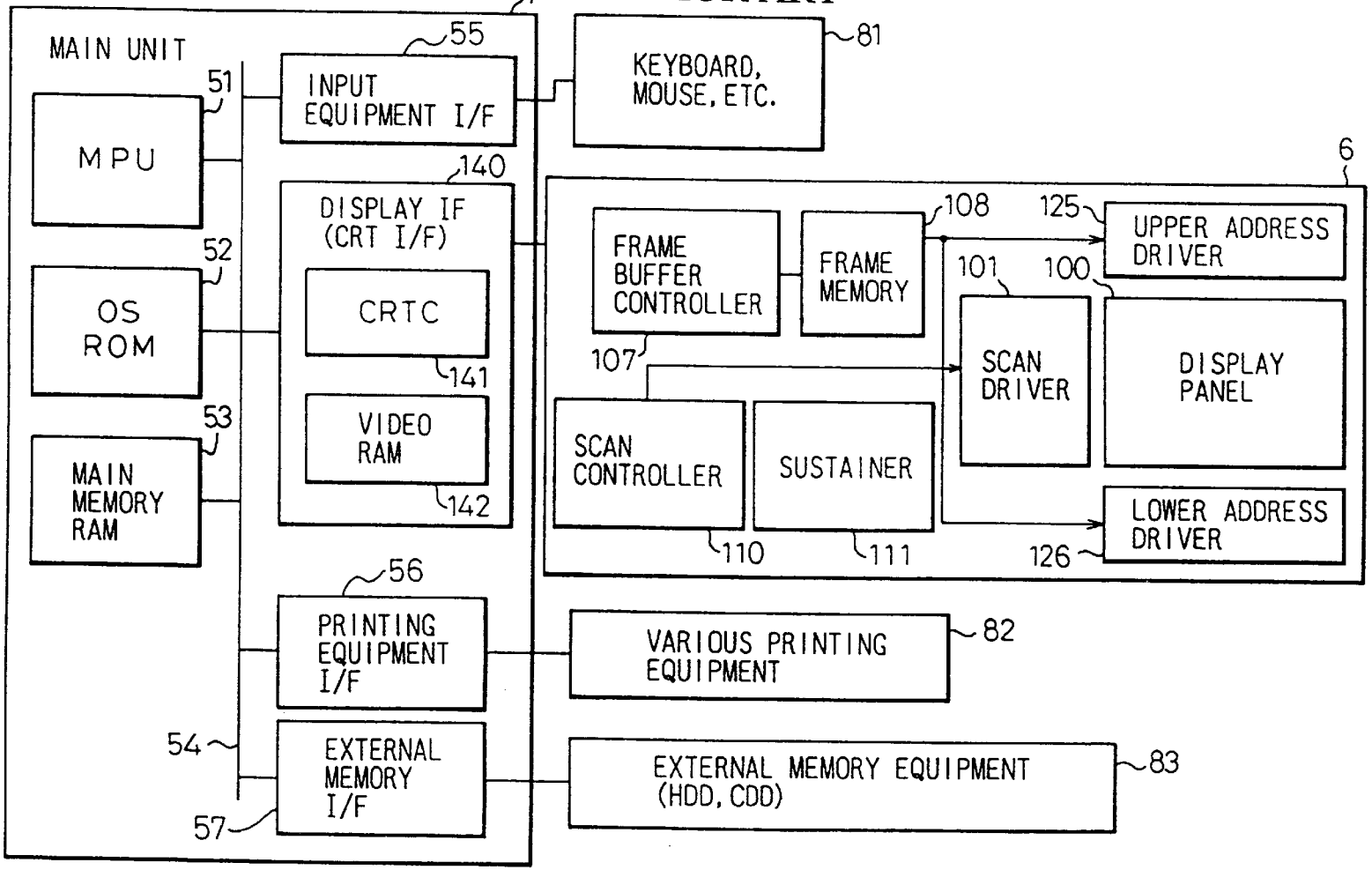
Fig. 7 PRIOR ART
FIG. 7 is a diagram showing the overall configuration of a known display.

FIG. 7 is a diagram showing the overall configuration of a known display for performing gray-scale display according to the subfield method by taking a personal computer for instance. In FIG. 7, reference numeral 1 denotes a main unit. 51 denotes a microprocessor unit (MPU). 52 denotes an OS-ROM for storing programs that run under an operating system (OS). 53 denotes a main memory RAM. 54 denotes an internal bus. 55 denotes an input equipment interface (I/F). 56 denotes a printing equipment interface (I/F). 57 denotes an external memory interface (I/F). 140 denotes a display equipment interface (I/F). 81 denotes an input equipment such as a keyboard or mouse. 82 denotes various printing equipment including a printer. 83 denotes an external memory equipment such as a HDD or CDD (CD drive). 6 denotes a display panel unit. The input equipment 81 is connected to the input equipment interface 55. The display panel unit 6 is connected to the display interface. The printing equipment 82 is connected to the printing equipment interface. The external memory equipment 83 is connected to the external memory interface. These connections are normally made by way of cables.

In an existing large-screen multicolor display type flat-panel display, a digital RGB interface conformable to the specifications of input timing for a CRT is adopted in general. This is because the main unit of the existing display usually outputs signals adapted to a CRT interface and the signals are intended to be shared with the main unit. Consequently, as shown in FIG. 7, the display interface 140 has a CRT controller (CRTC) 141 and video RAM 142. Display data is developed in the video RAM 142, and then read out and output in a format conformable to the specifications of input timing for a CRT.

Figure 8:
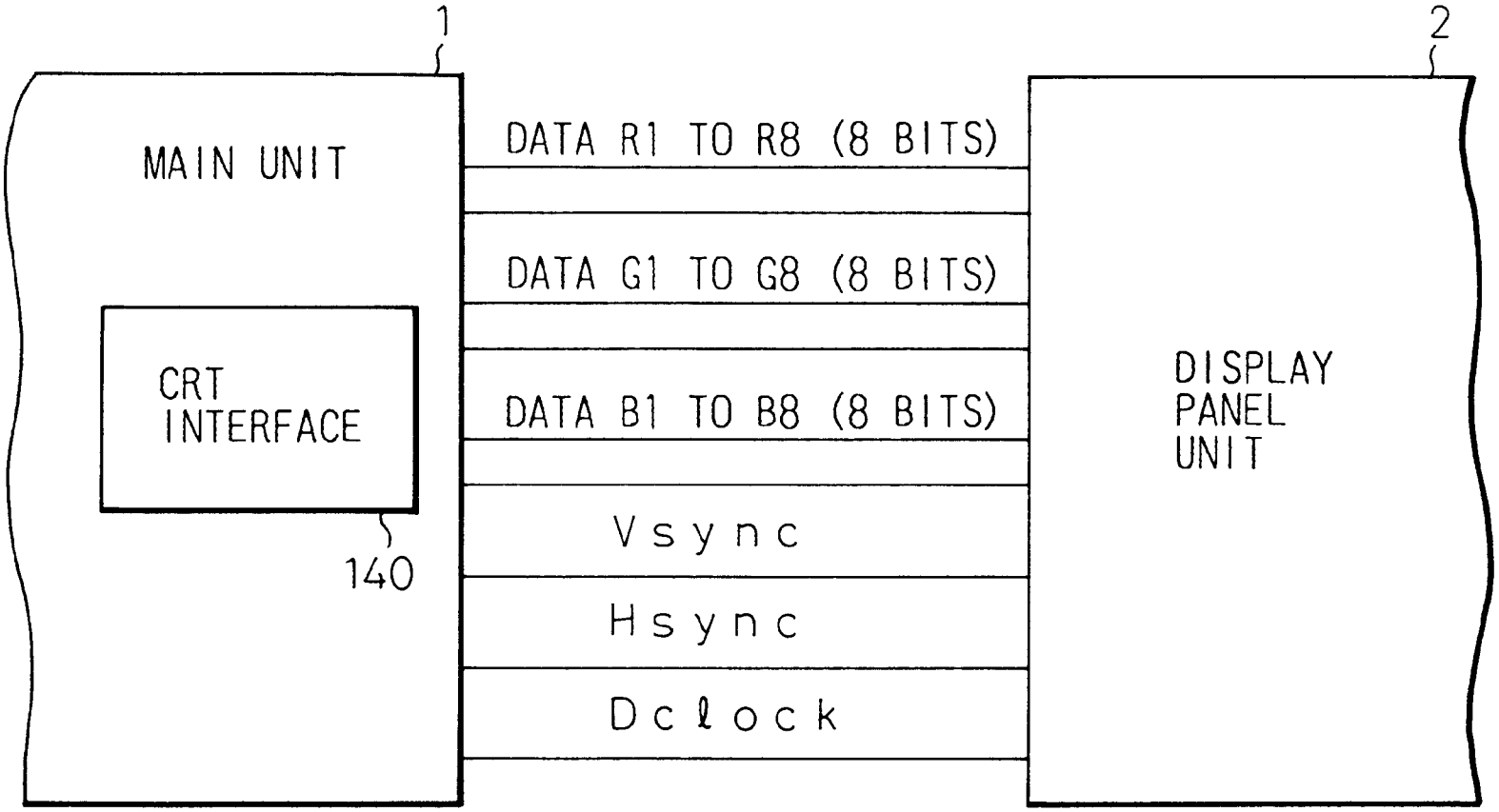
Fig. 8 PRIOR ART
FIG. 8 is a diagram showing an interface for a known display equipment.

FIG. 8 is a diagram showing the composition of signals needed when the main unit 1 outputs display data in the form of signals adapted to the CRT interface. FIG. 8 shows the signals representing data R, data G, and data B each of which is 8 bits long. The data R, data G, and data B, a vertical sync signal Vsync, a horizontal sync signal Hsync, and a clock Dclock are output from the main unit 1 to the display panel unit 2.

Figure 9:
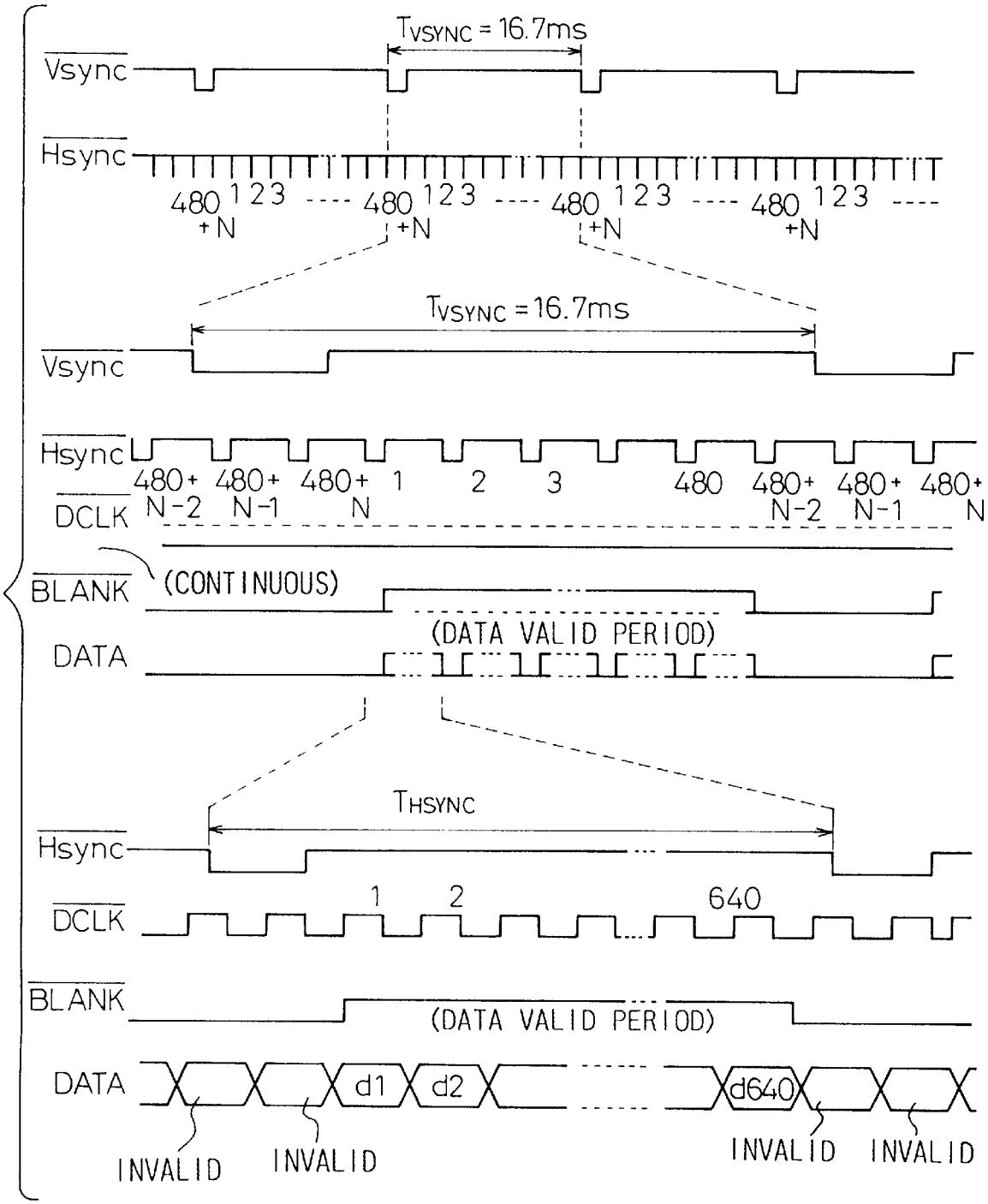
Fig. 9 PRIOR ART
FIG. 9 is a chart showing a known display data signal.

FIG. 9 is a chart showing in detail output signals to be supplied from the main unit 1 in the configuration shown in FIG. 8 to the display panel unit 2. The signals in FIG. 9 are already known and the description of the signals will therefore be omitted. Since each of the data R, G, and B is 8 bits long, data composed of 24 bits is transmitted in parallel. Assuming that a display unit is a CRT, each of data signals R, G, and B sent to the CRT is converted into a 256-level signal. An electron gun is then modulated in intensity. Thus, gray-scale display is achieved.

However, when gray-scale display is performed according to the subfield method as shown in FIG. 6, reset, addressing, and sustaining discharge must be executed for each bit of data R, G, and B. Drivers cannot be driven when signals adapted to a CRT interface are used as they are. Consequently, as shown in FIG. 7, the display panel unit 2 is provided with a frame buffer controller 107 and a frame memory 108. Display data sent from the display interface 140 in the main unit 1 is temporarily developed in the frame memory 108, and then read out bit by bit in a format matched with the subfield method. The read data is supplied to an upper address driver 125 and lower address driver 126. A scan controller 110 controls a scan driver 101 so that a scan pulse can successively scan scan buses in a panel 100. A sustainer 111 controls the sustaining discharge.

Figure 10:
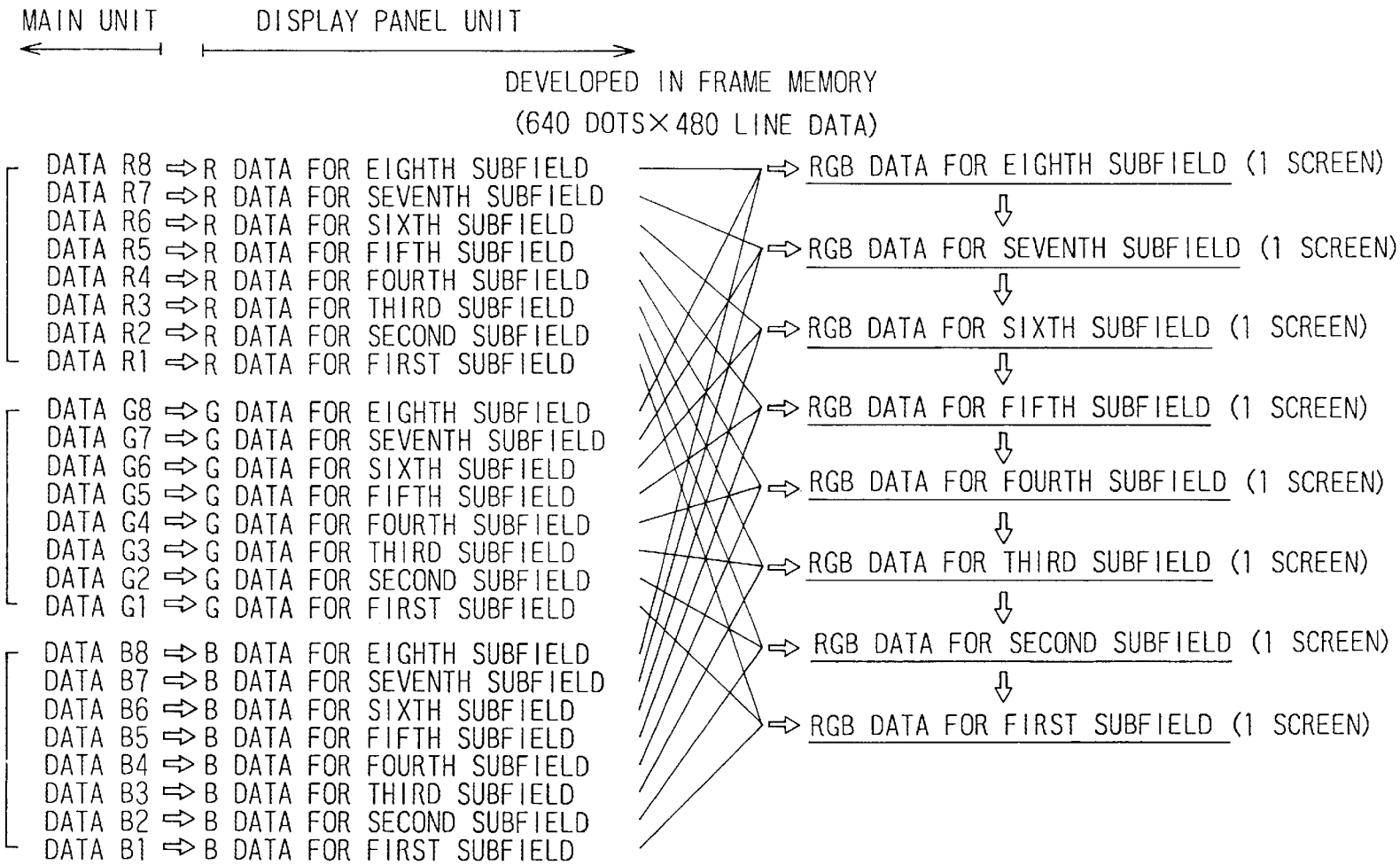
Fig. 10 PRIOR ART
FIG. 10 is a chart showing a known flow of processing display data.

FIG. 10 is a chart showing a change in the format of the data from 8-bit R, G, and B data that are sent in the aforesaid format matched with a CRT interface into data for eight subfields.

As shown in FIG. 10, 8-bit data R, G, and B are sent in parallel from the main unit. After receiving the data, the display panel unit temporarily develops the data in the frame memory. Thus, data R, G, and B for eight subfields can be read independently. Thereafter, reset, addressing, and sustaining discharge are executed for the data R, G, and B for each subfield as shown in FIG. 6. This sequence is repeated for all subfields. Thus, display for one frame is completed.

Figure 11:
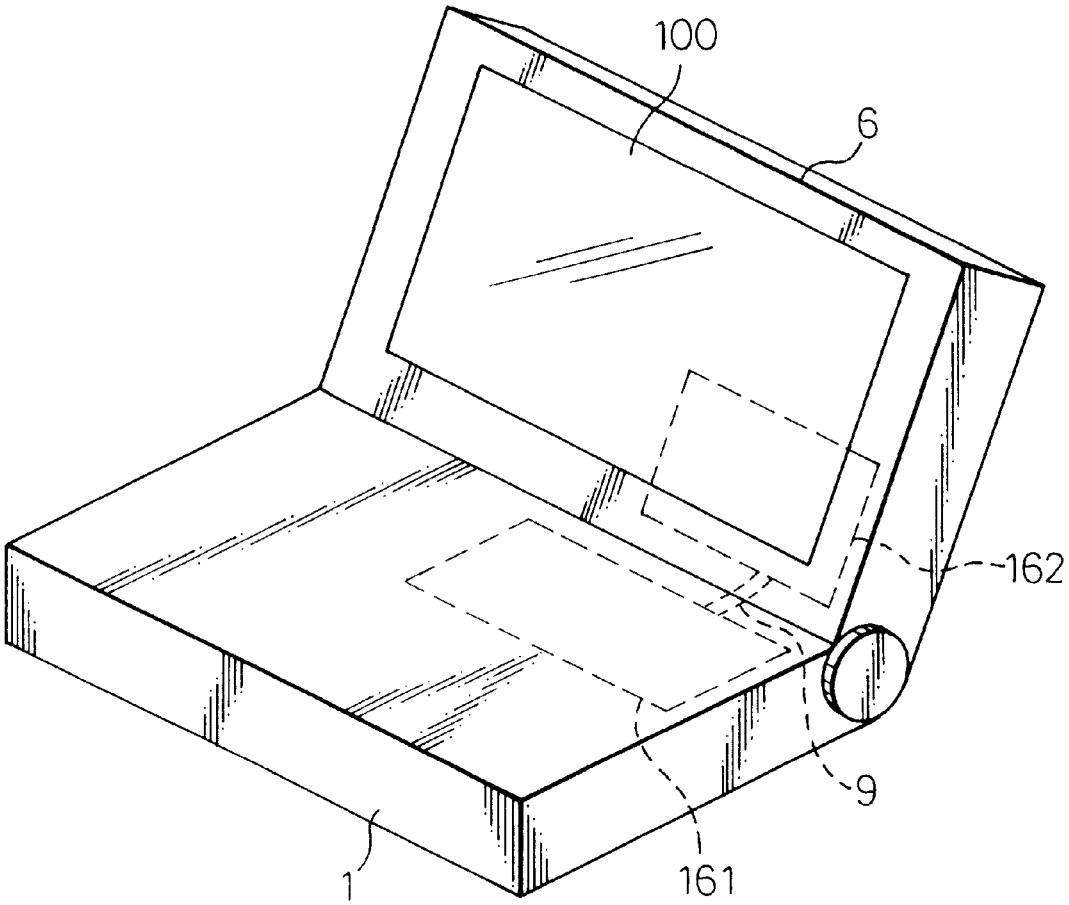
FIG. 11 shows the appearance of a known computer with which a display using a PDP is united.

FIG. 11 shows the appearance of a computer with which a display using a PDP is united. The display having the appearance of FIG. 11 has the same configuration as the one in FIG. 7. As illustrated, the display panel unit 6 is attached to the main unit 1 in such a manner that the display panel unit 6 can pivot. Connections of signals between the display panel unit and main unit are attained by way of a cable 9 linking a display interface printed-circuit board 161 incorporated in the main unit 1 and an interface printed-circuit board 162 incorporated in the display panel unit 6.

As mentioned above, in the known display, display data is transmitted from the main unit to the display panel unit in a format matched with a CRT interface. In this case, as shown in FIG. 7, the frame memories 108 and 142 must be installed in the main unit 1 and display panel unit 2 respectively. A frame memory needs a capacity large enough to store bits representing gray-scale levels for each display pixel. When the number of pixels is large, an enormous memory area is needed. In particular, when a color display is intended, three frame memories must be installed. The necessary memory area gets larger. Moreover, when it is attempted to unintermittently display data of frames that are fed consecutively, the display panel unit must write data for the next frame while reading written data from a frame memory. The same number of frame memories as the number of a plurality of frames must therefore be prepared so that the frame memories can be switched in order to perform writing and reading concurrently. Consequently, the necessary frame memory area further expands.

The display for performing gray-scale display according to the subfield method has a problem in that the necessary frame memory area is large. This poses a problem in that cost increases.

Figure 12:
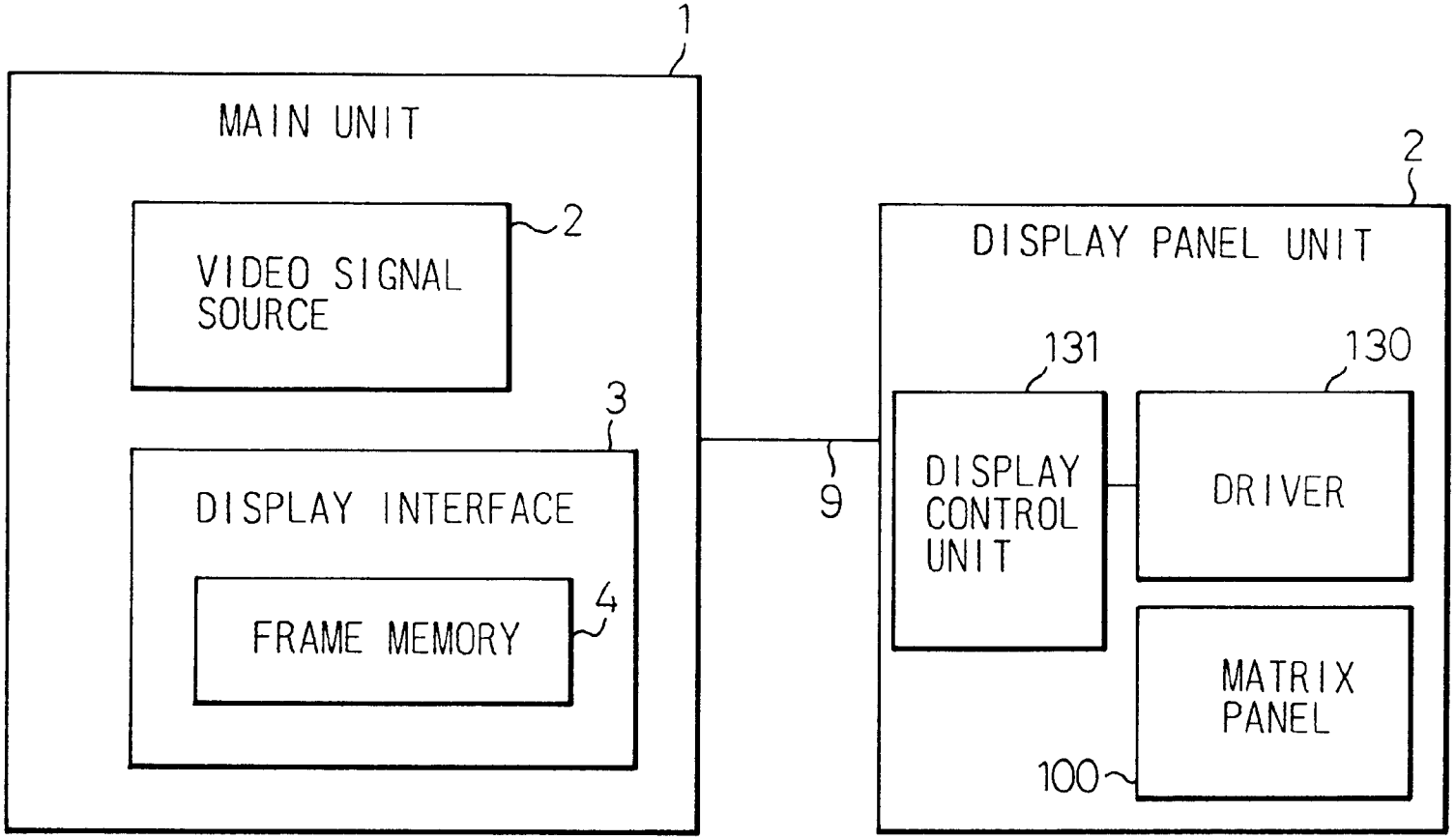
FIG. 12 shows the basic configuration of a PDP of the present invention.

FIG. 12 is a diagram showing the principle and configuration of a display of the present invention.

As shown in FIG. 12, the display of the present invention comprises: a main unit 1 including a video signal source 2 and a display interface 3 having a frame memory 4; a display panel unit 6 including a matrix panel 100 for performing gray-scale display according to a subfield method, a driver 130 for driving the matrix panel 100, and a display control unit 131 for receiving display signals from the display interface 3 in the main unit 1 and controlling the driver 130 so that display can be achieved according to the display signals; and a cable 9 linking the main unit 1 and display panel unit 6. The display interface 3 has a characteristic of transmitting display signals covering one frame in units of a subfield.

In the present invention, the format of display signals to be transmitted from the main unit to the display panel unit 6 is matched with the subfield method so that transmitted display signals can be used by the display panel unit 6 as they are. This obviates the necessity of writing and reading data, which is needed for converting one data format into another in the display panel unit 6, in and from a frame memory. It becomes possible to minimize the memory area and to downsize the logic circuits. Furthermore, since the time required for conversion becomes unnecessary, the response characteristic improves.

Figure 13:
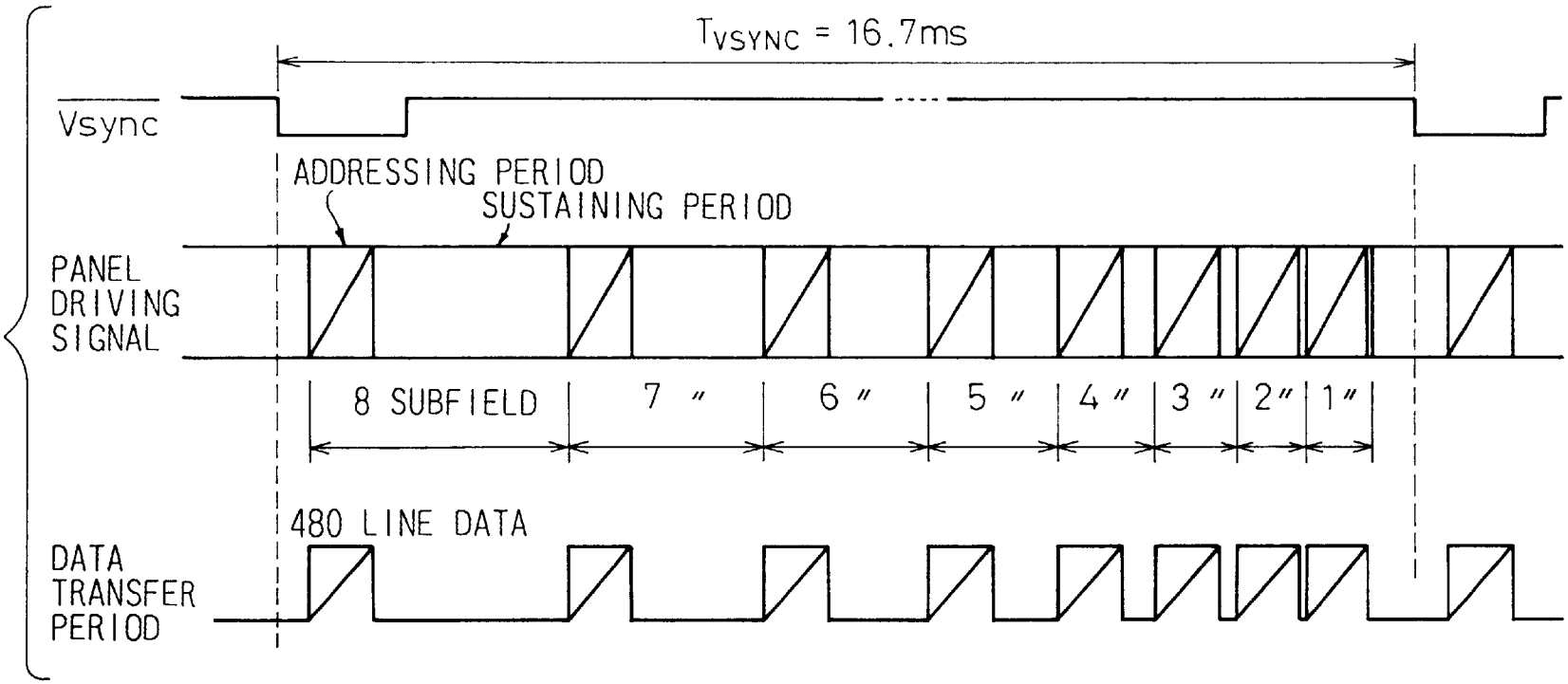
FIG. 13 is a timing chart indicating data transmission in the present invention.

FIG. 13 is a timing chart indicating the timing of transmitting display data signals in the present invention.

In a subfield method, time-sharing control is performed for each subfield associated with one bit of a display signal. For transmitting display signals from the main unit 1 to the display panel unit 6, one bit of the display signal associated with each subfield is transmitted according to the timing of the subfield. When the order of subfields or the length of a subfield is predetermined, the display interface 3 sends display data signals according to predetermined timing and the display control unit 131 in the display panel unit 6 receives the signals according to the timing.

Alternatively, the display interface 3 may output a subfield sync signal indicating the timing of starting transmission for each subfield in addition to sync signals Vsync and Hsync. In this case, the display control unit 131 identifies the subfield sync signal and performs the processing for attaining synchronism.

When the display panel unit 6 can vary the order of subfields during which lighting is effected; that is, the lighting order of subfields, the display control unit 131 transmits the information of the lighting order of subfields to the main unit 1. The display interface 3 transmits display signals according to the transmitted lighting order information.

In the subfield method, the measure of varying the lighting order of subfields is adopted in order to prevent the deterioration in display quality resulting from flickers, false contours, or the like of images. For varying the lighting order of subfields, the display panel unit 6 transmits the lighting order to the main unit 1 so that display signals can be transmitted according to the transmitted lighting order information. Thus, display can be achieved normally.

When the display panel unit writes data concurrently in a plurality of blocks into which the matrix panel 100 is segmented, the display interface 3 transmits display signals in parallel in association with the plurality of blocks.

In a display for writing data concurrently in display cells; such as, a display panel unit, the writing speed is determined with the ability of a driver for driving address lines (data lines) to drive a data shift register. For increasing the writing speed or operating speed, the driving ability relative to the data shift register must be improved. However, there is a limit to the improvement. Therefore, the address lines are grouped into a plurality of blocks, and data is written concurrently in the blocks. In this case, the display interface 3 should transmit display signals in parallel in association with the plurality of blocks.

Figure 14:
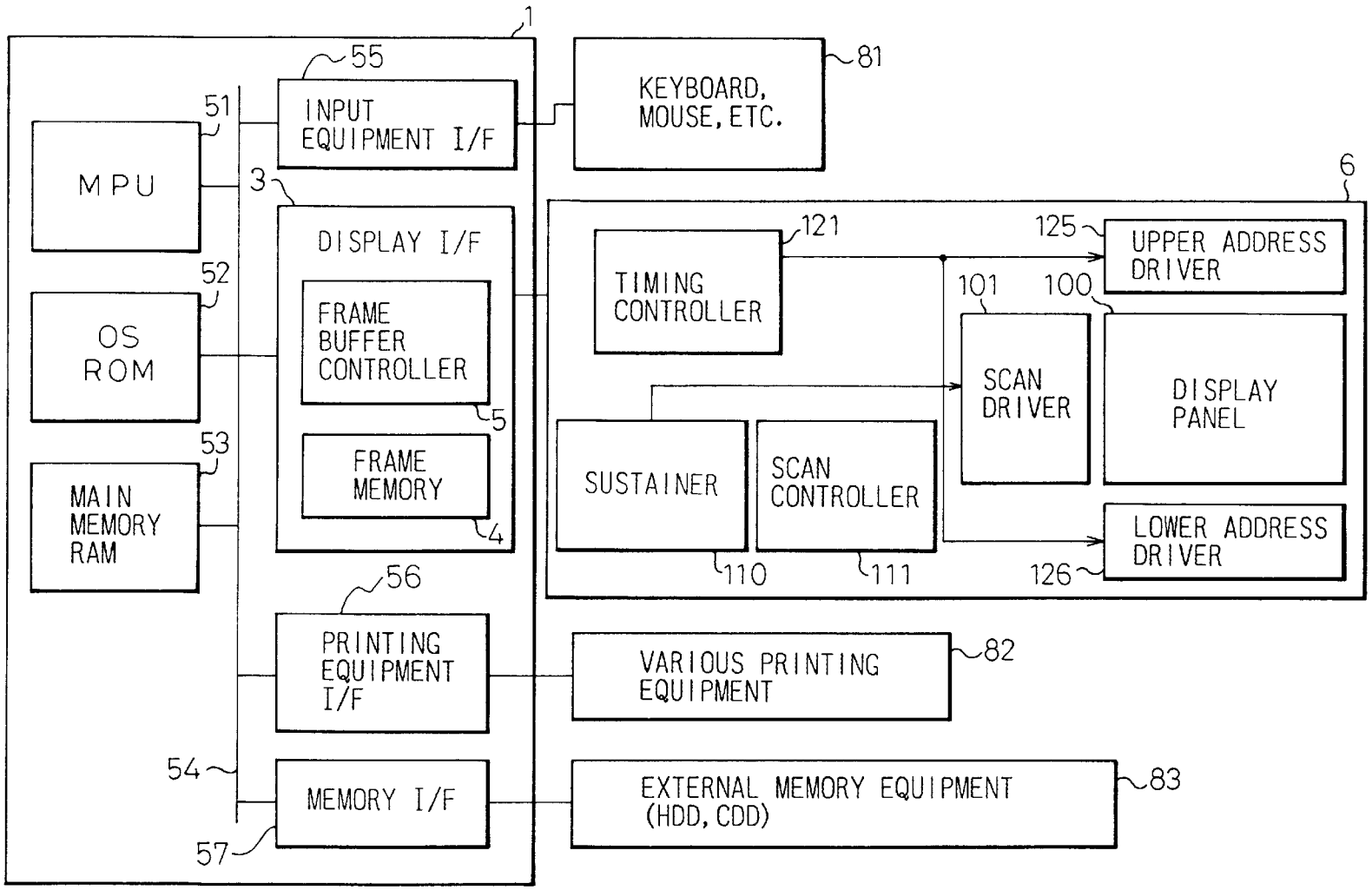
FIG. 14 is a diagram showing the overall configuration of a display of an embodiment.

FIG. 14 is a diagram showing the overall configuration of a display of an embodiment of the present invention.

As is apparent from comparison with FIG. 7, the display of this embodiment has substantially the same configuration as the known display shown in FIG. 7 except for parts of the display interface 3 and display panel unit 6. Only the differences will be described.

As shown in FIG. 14, the display interface 3 includes a frame buffer controller 5 and frame memory 4. Similar to the video RAM in the known display, the MPU 51 can access the frame memory 4 via the frame buffer controller 5. The frame buffer controller 5 reads display data written in the frame memory 4 according to the subfield method as shown in FIG. 13 and outputs the data to the display panel unit 6.

The display panel unit 6 includes a timing controller 121 in place of the frame buffer controller 107 and frame memory 108 shown in FIG. 7. Since display data signals sent from the display interface 3 are adapted to the subfield method, the timing controller 121 outputs the display data signals to the upper address driver 125 and lower address driver 126 as they are after adjusting timing.

As is apparent from a comparison between FIGS. 14 and 7, in this embodiment, the display panel unit 6 does not have a frame memory. Signals are merely adjusted in timing and then output to the address drivers as they are.

Figure 15:
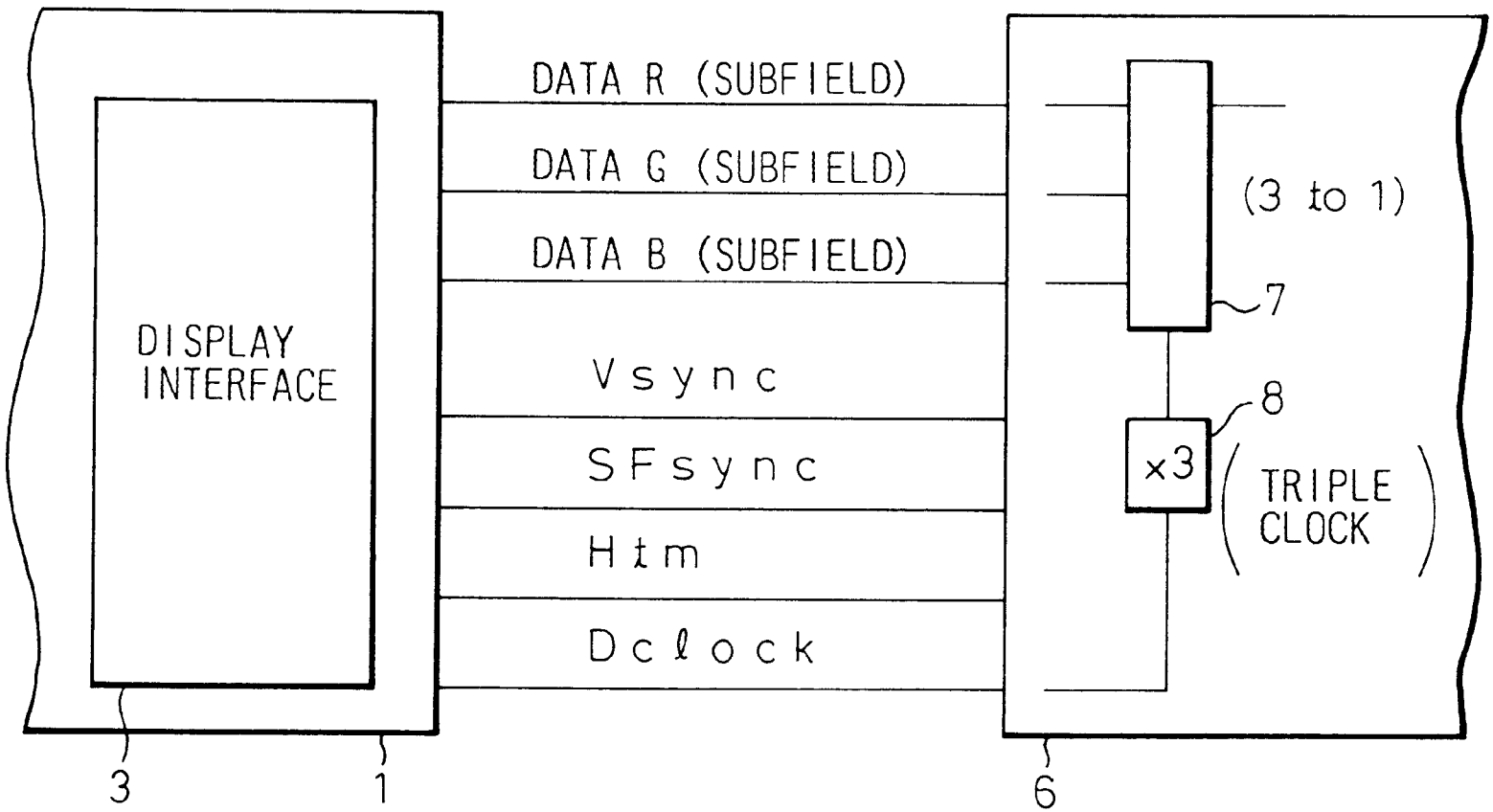
FIG. 15 is a diagram showing an interface of the first embodiment.

FIG. 15 shows the configuration of an interface in the first embodiment. Display data signals sent from the main unit 1 to the display panel unit 6 are expressed in the subfield format. Each R, G, and B data is therefore one bit long. In addition to the data signals, a vertical sync signal Vsync, subfield sync signal SFsync, horizontal sync signal Htm, and clock Dclock are sent. In the display panel unit 6, a multiplexer 7 groups together the data R, G, and B data into one data signal according to an output of a frequency multiplier 8 for multiplying the frequency of the clock Dclock by 3. The resultant data signal is sent to the address drivers.

Figure 16:
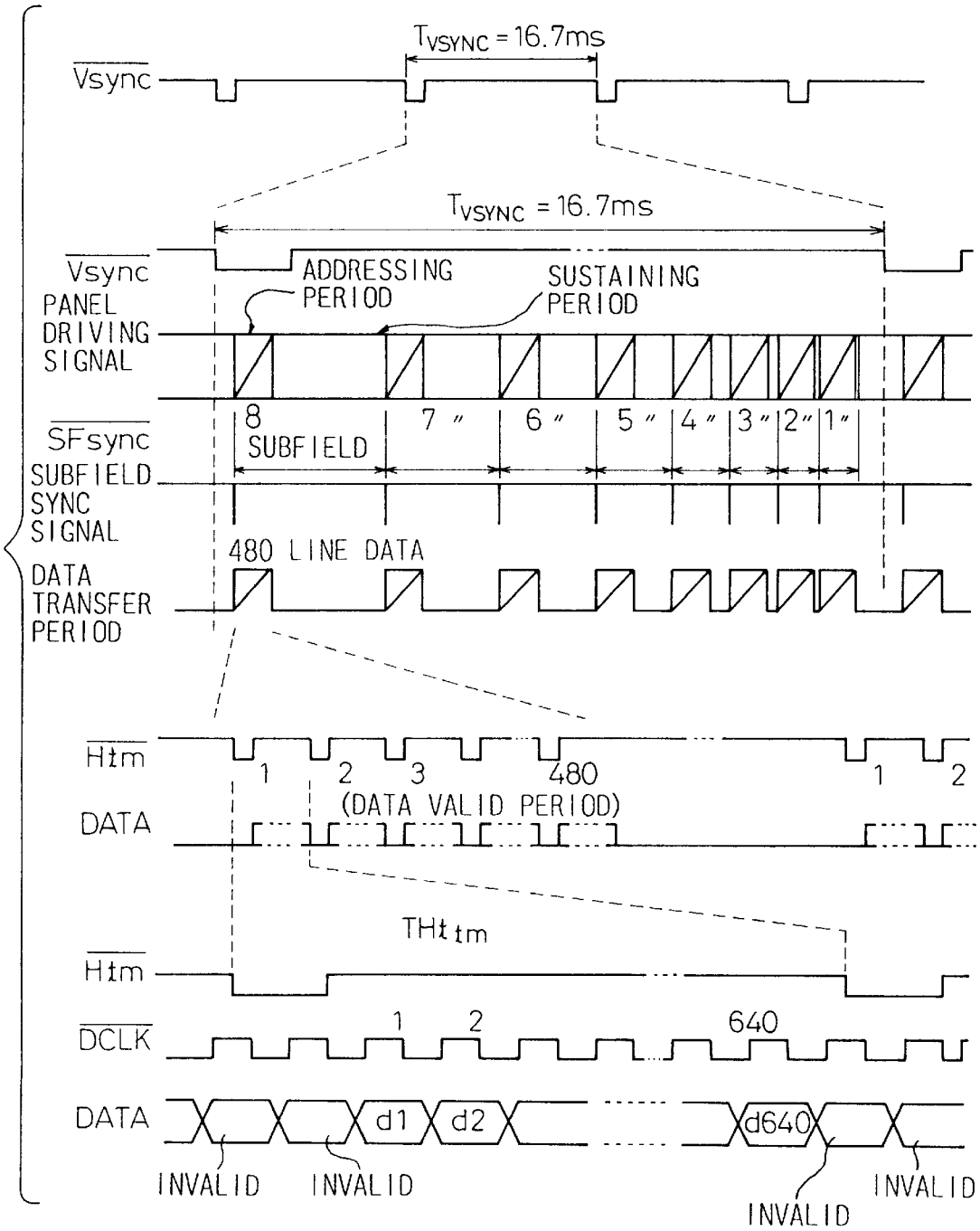
FIG. 16 is a chart showing a display data signal of the first embodiment.

FIG. 16 is a timing chart indicating display data signals in the first embodiment.

The frequency of a sync signal Vsync, similarly to that handled by the CRT interface, is 16.7 ms, and one cycle of the sync signal Vsync is divided into periods corresponding to eight subfields. Each subfield is divided into an addressing period and sustaining (sustaining discharge) period. As described in conjunction with FIG. 6, in reality, a reset period is defined. Herein, the reset period is omitted. The length of the sustaining period within each subfield is determined according to the degree of weighting an associated bit of display data. A pulse SFsync is output at the start of each subfield.

A pulse Htm is output in a given cycle during the addressing period within each subfield. Display bit data associated with an address to be scanned during the subfield is output synchronously with the pulse Htm. Display bit data (covering one horizontal line) is output synchronously with a clock Dclock during one cycle of the pulse Htm.

Figure 17:
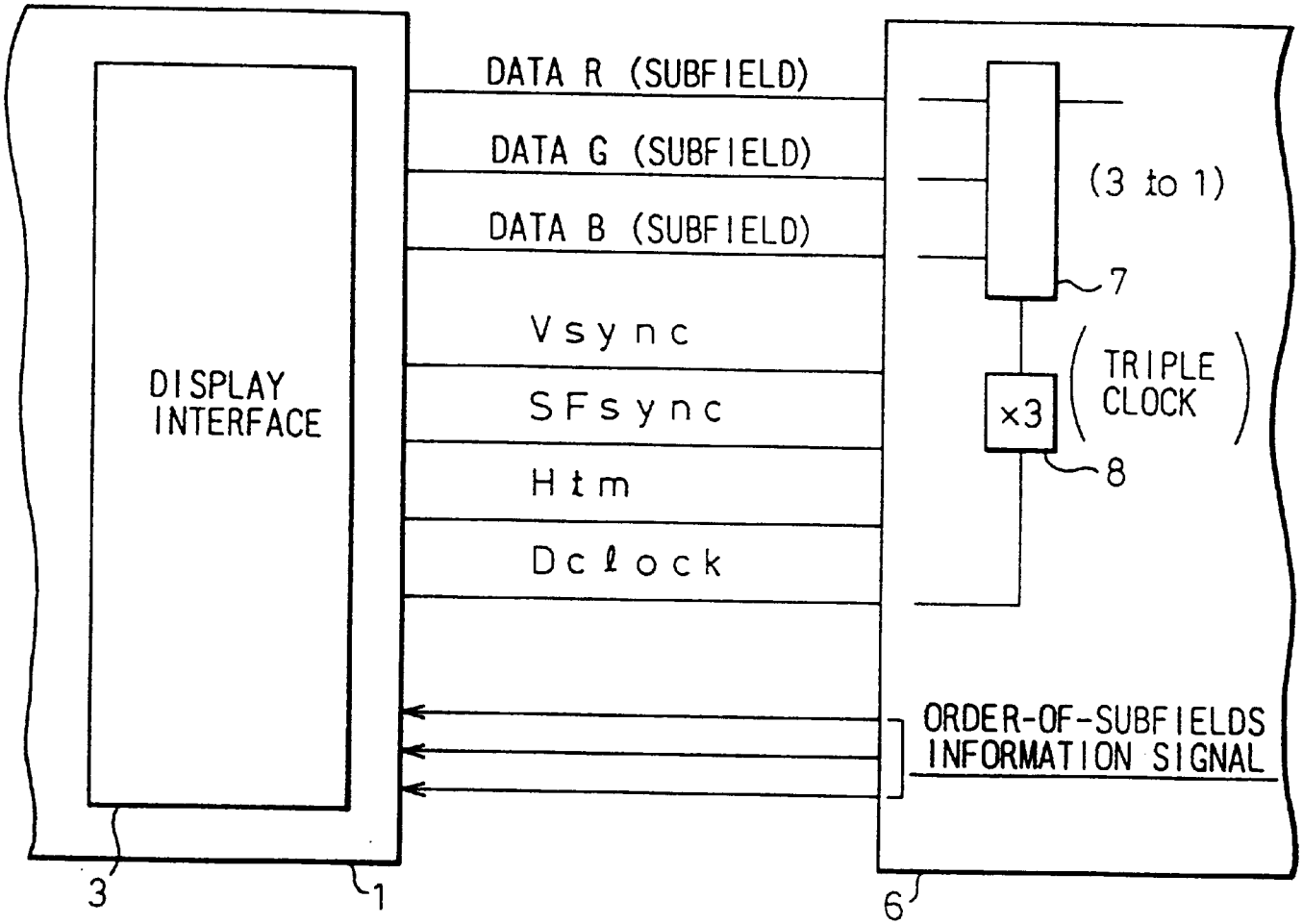
FIG. 17 is a diagram showing an interface of the second embodiment.

FIG. 17 is a diagram showing an interface in the second embodiment. The other components are identical to those of the first embodiment.

As already described, the measure of varying the order of subfields during which lighting is effected; that is, the lighting order of subfields is adopted in order to minimize flickers, false contours, or the like of images and thus improve display quality. In the second embodiment, the lighting order of subfields is varied. When the display panel unit 6 varies the lighting order of subfields, the order of transmitting display data from the main unit 1 must be varied accordingly. In the second embodiment, the display panel unit 6 outputs an order-of-subfields information signal concerning the varied lighting order of subfields. In response to the order-of-subfields information signal, the main unit 1 varies the order of transmitting display data; that is, the transmission order. The transmission order can be varied merely by changing areas in the frame memory 4 to be read.

Figure 18:
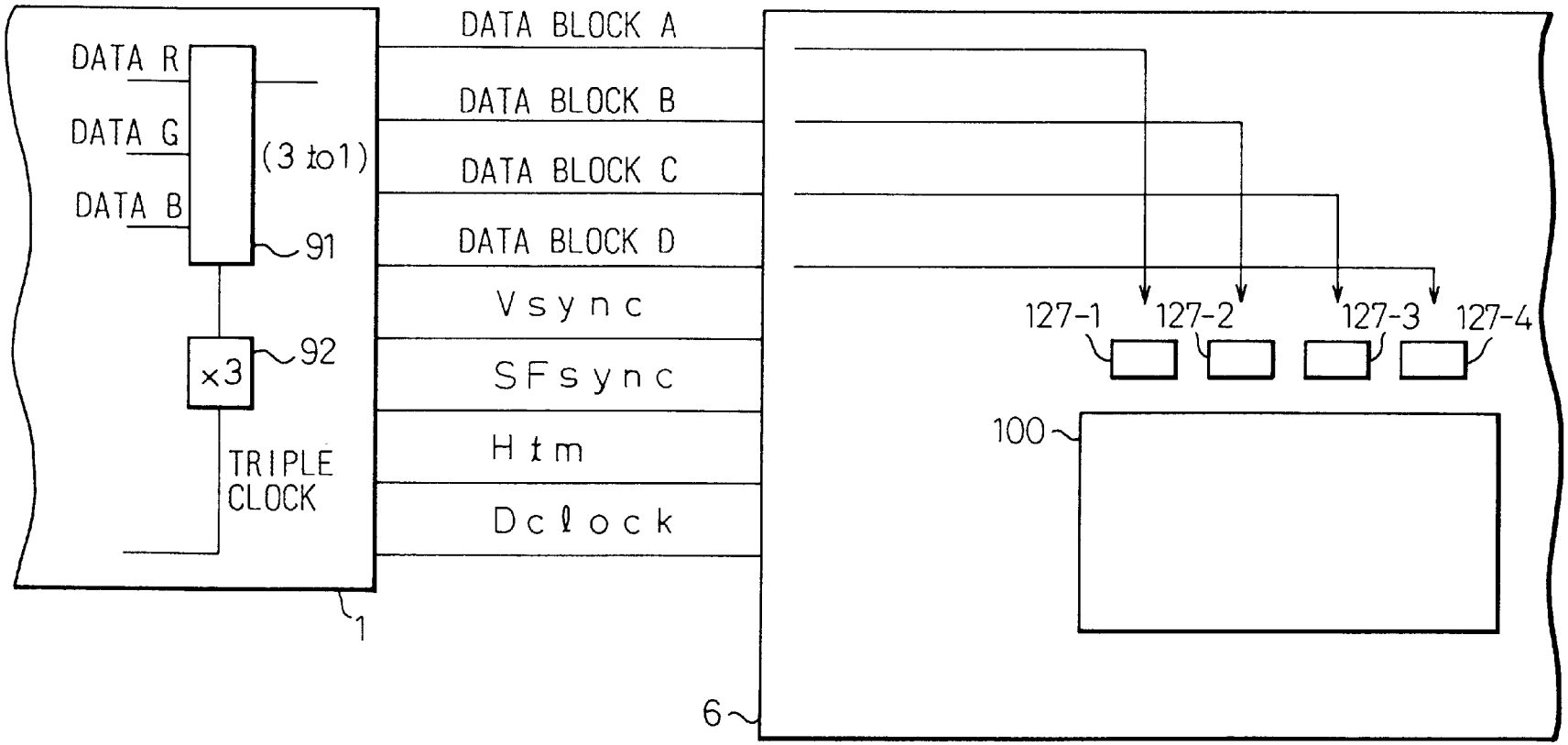
FIG. 18 is a diagram showing an interface of the third embodiment.

FIG. 18 is a diagram showing an interface in the third embodiment. The other components are identical to those of the first embodiment.

As already described, in a display for writing data concurrently in display cells; such as, in a display panel unit, the cells are grouped into a plurality of blocks in units of an address line (data line). Data is written concurrently in the blocks. The third embodiment is an example of adopting this technique. Display data written in the frame memory 4 is converted from R, G, and B data into a serial signal by a multiplexer 91 according to a signal sent from a triple frequency multiplier 92 when it is read out. This is performed in units of four blocks. Consequently, signals to be transmitted include data signals associated with four blocks, a sync signal Vsync, a subfield sync signal SFsync, a horizontal sync signal Htm, and a clock Dclock. Each data signal has data signals R, G, and B arranged alternately.

The display panel unit 6 supplies the transmitted display data signals to address drivers 127-1, 127-2, 127-3, and 127-4 associated with the blocks. Writing is then performed block by block.

As described so far, according to the present invention, it becomes possible to minimize the frame memory area in a display for performing gray-scale display according to a subfield method, and to reduce cost drastically. Moreover, the display speed improves.

We claim:

1. A display, comprising:

a main unit including a video signal source and a display interface having a frame memory;

a display panel unit including a matrix panel for performing gray-scale display according to a subfield method, a driver for driving said matrix panel, and a display control unit for receiving display signals from said display interface in said main unit and controlling said driver so that display can be achieved according to said display signals; and a cable for linking said main unit and said display panel unit;

wherein said display interface transmits said display signals to said display control unit in units of a subfield for each frame of said display signals.

2. A display according to claim 1, wherein said display interface outputs a subfield synchronizing signal.

3. A display according to claim 1, wherein said display panel unit can vary the order of subfields during which lighting is effected; that is, the lighting order of subfields, said display control unit transmits information of said lighting order of subfields to said main unit, and said display interface transmits display signals according to said transmitted lighting order information.

4. A display according to claim 1, wherein said display panel unit writes display data concurrently in a plurality of blocks into which said matrix panel is segmented, and said display interface transmits display signals in parallel in association with said plurality of blocks.

5. A display panel unit, connected to a main unit which includes a video signal source and a display interface having a frame memory, by way of a cable, comprising:

a matrix panel for performing gray-scale display according to a subfield method, a driver for driving said matrix panel, and a display control unit for receiving display signals from said display interface in said main unit and controlling said driver so that display can be achieved according to said display signals;

wherein said display control unit receives said display signals from said display interface in units of a subfield for each frame of said display signals.

6. A display panel unit according to claim 5, wherein said display control unit receives a subfield sync signal and controls display of each subfield on the basis of said subfield sync signal.

7. A display panel unit according to claim 5, wherein said display panel unit can vary the order of subfields during which lighting is effected; that is, the lighting order of subfields, and said display control unit transmits information of said lighting order of subfields to said main unit.

8. A display panel unit according to claim 5, wherein said display panel unit performs writing of display data into said matrix panel concurrently into a plurality of blocks into which said matrix panel is segmented, and said display control unit receives display signals in parallel in association with said blocks.

9. A display signal generator, comprising:

a video signal source; and a display interface having a frame memory, being connected to a display panel unit for performing gray-scale display according to a subfield method by way of a cable, and outputting display signals to said display panel unit;

wherein said display interface transmits said display signals to said display panel unit in units of a subfield for each frame of said display signals.

10. A display signal generator according to claim 9, wherein said display interface outputs a subfield sync signal.

11. A display signal generator according to claim 10, wherein said display panel unit can vary the order of subfields during which lighting is effected; that is, the lighting order of subfields, and is designed to transmit information of said lighting order of subfields to said main unit, and said display interface transmits display signals according to said transmitted lighting order information.

12. A display signal generator according to claim 9, wherein said display panel unit performs writing of display data into said matrix panel concurrently into a plurality of blocks into which said matrix panel is segmented, and said display interface transmits display signals, in parallel, in association with said plurality of blocks.

* * * * *